United States Patent [19]

Nakamura

[11] 4,165,348

[45] Aug. 21, 1979

[54] APPARATUS FOR FUEL SUPPLY TO SPARK IGNITION TYPE INTERNAL COMBUSTION ENGINE

[75] Inventor: Rinjiro Nakamura, Tokyo, Japan

[73] Assignee: Chiyoda Chemical Engineering and Construction Company Ltd., Yokohama, Japan

[21] Appl. No.: 824,307

[22] Filed: Aug. 12, 1977

[30] Foreign Application Priority Data

Aug. 26, 1976 [JP] Japan ..... 51/101061

[51] Int. Cl.[2] ..... F02M 7/20

[52] U.S. Cl. ..... 261/36 A; 123/139 AW; 261/18 A; 261/65; 261/44 H; 261/118; 261/DIG. 39

[58] Field of Search ..... 261/36 A; 123/139 AW; 261/18 A, 65, 44 H, DIG. 39, 118

[56] References Cited

U.S. PATENT DOCUMENTS

| | | | |
|---|---|---|---|
| 1,085,233 | 1/1914 | Ahlberg | 261/36 A |
| 1,914,787 | 6/1933 | Puurmann | 261/36 A |
| 2,136,959 | 11/1938 | Winfield | 261/36 A |
| 2,247,189 | 6/1942 | De Guyon | 261/DIG. 39 |
| 2,389,922 | 11/1945 | Mennesson | 261/34 A |
| 2,414,322 | 1/1947 | Mock | 261/36 A |
| 2,440,566 | 4/1948 | Armstrong | 261/36 A |
| 2,531,479 | 11/1950 | Southern et al. | 261/DIG. 38 |
| 2,649,081 | 8/1953 | Martienssen | 261/18 A |
| 2,793,014 | 5/1957 | Melchior | 261/18 A |
| 2,874,944 | 2/1959 | Dolza | 261/36 A |
| 2,893,365 | 7/1959 | Haefner | 123/139 AW |
| 2,927,568 | 3/1960 | Sagady | 123/139 AW |
| 2,957,464 | 10/1960 | Dolza | 123/139 AW |
| 2,975,941 | 3/1961 | De Claire, Jr. | 123/139 AW |
| 2,997,036 | 8/1961 | Graham | 123/139 AW |
| 3,061,286 | 10/1962 | Mennesson | 261/36 A |
| 3,271,014 | 9/1966 | Wu | 261/43 |
| 3,427,006 | 2/1969 | Oiestad | 261/DIG. 54 |
| 3,567,191 | 3/1971 | Morgan | 261/36 A |
| 3,750,636 | 8/1973 | Okura | 123/139 AW |
| 3,800,769 | 4/1974 | Graffman | 261/36 A |
| 3,953,548 | 4/1976 | Knapp | 261/DIG. 39 |
| 3,983,850 | 10/1976 | Stumpp et al. | 123/139 AW |

FOREIGN PATENT DOCUMENTS

| | | | |
|---|---|---|---|
| D 14880 | 10/1955 | Fed. Rep. of Germany | 261/65 |
| 2448442 | 4/1975 | Fed. Rep. of Germany | 261/50 A |

*Primary Examiner*—Tim R. Miles

*Attorney, Agent, or Firm*—Wenderoth, Lind & Ponack

[57] ABSTRACT

In a fuel supply apparatus and method for a spark ignition type of internal combustion engine, a variable throttle is provided in a bypass between the discharge side and the suction side of a volume type fuel pump. The variable throttle is regulated by a pressure adjusting device which makes the ratio of the differential pressure between atmospheric pressure and the negative static pressure in the air intake of the engine and the pressure on the discharge side of the fuel pump equal to n. The value of n is set so that the flow of the fluid in a jet nozzle connected to the discharge side of the fuel pump will be turbulent. The spray from the jet nozzle is blended with the air sucked into the engine and the mixture is supplied to the engine intake manifold through a volume control device.

12 Claims, 24 Drawing Figures

3'
4
S
5
3
3
16
15
14
1'
9
1
2
L
2'
s
6
10a
12
13
10

APPARATUS FOR FUEL SUPPLY TO SPARK IGNITION TYPE INTERNAL COMBUSTION ENGINE

The present invention relates to an apparatus and method of supplying fuel to a spark ignition type internal combustion engine.

BACKGROUND OF THE INVENTION AND PRIOR ART

The conventional auto carburetor is constructed as shown diagrammatically in FIG. 1. In such a carburator the fuel is first introduced through a fuel supply pipe f into a float chamber a, where the fuel level is kept constant by means of the float b, acting on the float valve c. The fuel level and the level of the fuel jet port d at the center of the Venturi V in the intake conduit are at substantially the same level. A negative pressure is developed in the Venturi V by air being sucked therethrough into the engine and this negative pressure draws the fuel from the float chamber a into the Venturi V through the fuel jet port d through the throttle e.

Designating the pressure upstream of the Venturi V as $P_1$, the velocity of the air upstream as $V_1(V_1=0)$, the pressure of the fluid in the Venturi V as $P_2$, the velocity of the fluid in the Venturi V as $V_2$ and the specific gravity of air as $\rho a$, the following relationships exist according to Bernoulii's law:

$$\frac{V_2^2}{2g} = \frac{P_1 - P_2}{\rho a}$$

$$\therefore P_2 = P_1 - \frac{\rho a/V_2^2}{2g}$$

Therefore, the negative pressure in the Venturi V, being equal to $$\frac{\rho a/V_2^2}{2g};$$

may be considered to be the velocity head.

Meanwhile, a pressure difference occurs between the pressure upstream and the pressure downstream of the throttle e. If the flow velocity in the throttle e is $V_3$, and the height of the fuel level in the float chamber a above the horizontal part of the throttle e is h and the specific qravity of fuel is $\rho t$, the pressure in the throttle e can be expressed, also according to Bernoulli, as follows:

$$CV_3^2/2g - h = \frac{P_1 - P_2}{\rho f} \quad \text{(a)}$$

$$P_2 = P_1 - \frac{C\rho f V_3^2}{2g} + h\rho t$$

where g is the acceleration due to gravity and C is a flow constant. Thus the negative pressure in the throttle e which is equal to $$C\frac{\rho f V_2^3}{2g},$$

is constant. The reason is that, if $$\frac{\rho a V_2^2}{2g} = C\frac{\rho f V_3^2}{2g},$$

the value $$\frac{V_3}{V_2} = (C\frac{\rho a}{\rho f})^{\frac{1}{2}}$$

which is a constant, so that the air/fuel ratio can be maintained constant regardless of how the volume of air sucked in may change. As a matter of fact, however, even if the air/fuel ratio is set appropriately for a given air volume, it will be different for a different air volume. The reason is that, in the conventional system described above, the air flow in the Venturi V is turbulent, whereas the fuel flow in the throttle e is laminar, which the above equation (a) does not take into account.

The present invention seeks to overcome this drawback in conventional carburators.

SUMMARY OF THE INVENTION

The first object of the present invention is to provide a fuel supply apparatus and method for a spark ignition type internal combustion engine as well as a pressure adjusting device for the fuel supply apparatus, by which the fluid flow in the jet nozzle connected to the discharge side of a pump can be made as turbulent as the air flow in the Venturi so that in spite of wide variations in the volume of air being sucked into the engine, the air/fuel ratio can be maintained at approximately the theoretical value.

The second object of the present invention is to provide such an apparatus and method in which the fuel can be satisfactorily atomized with good blending of fuel and air, whereby combustion at a lean air-fuel ratio is possible, fuel consumption can be reduced, kerosene or the like (herein-after referred to as "heating oil") can be used as fuel, and efficient combustion can be achieved using an economical, safe fuel with a low ignition point.

These objects are achieved according to the present invention, by an apparatus in which a variable throttle is provided in a bypass installed between the discharge side and the suction side of a volume type fuel pump. Said variable throttle is regulated by a pressure adjusting device which makes the ratio of the differential pressure between atmospheric pressure and the pressure at an air flow measuring device in the air suction path of the engine and the pressure on the discharge side of the fuel pump equal to n, n being set at such a value that the fluid flow in the jet nozzle connected to the discharge side of the fuel pump will be turbulent. A mixing chamber is provided in which the spray from the jet nozzle can be mixed with the air sucked in, and the mixing chamber is connected via a mixture volume control device to the intake manifold of the fuel supply system in the engine.

In the apparatus according to the present invention it is preferable to use a conventional swirl type nozzle as the jet nozzle.

Preferably, the various parts of said apparatus are constructed as follows. The throttle provided in the bypass between the discharge side and the suction side of the fuel pump is formed by a concentric gap between a cylinder and a piston and the length of said gap is controllable.

In the flow measuring mechanism, the flow rate is measured by utilizing the difference between the static pressure and the dynamic pressure in a Venturi in the air intake.

The mixing device has the jet nozzle located in the top wall on the central axis of the mixing chamber; air suction ports are located at the top and bottom of the outer wall of the mixing chamber; and the outlet port for the mixture of air and fuel is located in the bottom wall on said central axis. It is preferable to provide an annular air filter outside of a partition wall around the mixing chamber.

On the outlet side of the mixing device is a throttle valve in the form of a flexible tube which is radially deformable along a length thereof greater than the cross-sectional area thereof.

A bypass around the Venturi in the air intake is provided and in this bypass is an air/fuel ratio adjuster provided with a throttle.

The objects of the invention are further achieved by the method of using the above-described apparatus.

The variable throttle in the bypass between the discharge side and the suction side of the volume type fuel pump is regulated by the pressure adjusting device so as to make the ratio of the differential pressure between atmospheric pressure and the pressure measured by the air flow measuring device in the air intake of the engine and the pressure on the discharge side of the fuel pump equal to n, the value of n being such that the fluid flow in the jet nozzle connected to the discharge side of the fuel pump is turbulent. The spray from said jet nozzle is blended with the air sucked into the air intake and the mixture is supplied to the suction manifold through the volume control mechanism.

In the above method it is preferable to use heating oil, gasoline or a mixture of heating oil and gasoline as the fuel.

The effect of said process is further enhanced by making it possible to adjust the ratio of the heating oil and the gasoline at the inlet port of the fuel pump to the desired ratio from the driver's seat of the vehicle in which the engine is mounted.

Acceleration is adjusted by supplying gasoline to the mixing chamber where the spray from the jet nozzle is mixed with the air.

Two sets of volume type fuel pumps and pressure adjusting devices can be provided in parallel, the fuel being supplied from the discharge side of the pump in one set to the mixing chamber through one jet nozzle, and water being supplied from the discharge side of the pump in the other set to the mixing chamber through a second jet nozzle.

The present invention also relates to a novel pressure adjusting device which is particularly useful in the fuel supply apparatus and method according to the present invention, and which is also useful in other similar apparatus and methods.

The pressure adjusting device has one end of a piston rod fixed to the bellows plate of a bellows in a bellows chamber integral with the cylinder in which the piston is slidable. A gap of length l is formed around a part of the inside of said cylinder around the piston rod movable in said cylinder. Said gap communicates with the suction side of the volume type pump. The inner end of said cylinder communicates with the discharge side of said pump. The outside of said bellows communicates with the atmosphere, and the inside of the bellows communicates with the throat of a Venturi in the air intake to the mixing chamber. The ratio between the external area of said bellows plate and the area of the end of said piston is equal to n.

It is preferable to dispose the piston rod parallel to the direction of travel of a vehicle equipped with such a pressure adjusting device so that the bellows faces in the traveling direction. It is further preferable to connect the atmospheric side of the bellows to an acceleration mechanism.

BRIEF DESCRIPTION OF THE DRAWINGS

Other objects, features and advantages of the present invention will become apparent from the following detailed description taken in conjunction with the attached drawings, wherein:

FIG. 2(*b*) is a schematic front elevation view showing a second embodiment of the present invention;

FIG. 8(*b*) is a sectional view along 8*b*—8*b* line of FIG. 8(*a*);

FIGS. 9(*b*)–(*d*) are views of a suction throttle for use in the present invention. FIG. 9(*b*) being a front view, FIG. 9(*c*) being sectional view along 9*c*—9*c* line in FIG. 9(*b*) and FIG. 9(*d*) being a sectional view along 9*d*—9*d* line in FIG. 9(*b*);

FIG. 9(*e*) is a schematic plan view illustrating the use of the suction throttle shown in FIGS. 9(*b*)–(*d*).

FIG. 9(*f*) is a front elevation view partly in section and partly diagrammatic of an engine acceleration mechanism for use in the present invention;

FIG. 9(*g*) is a diagrammatic view of another engine acceleration mechanism for use with the present invention;

FIG. 9(*h*) is a schematic view illustrating a mechanism for supplying to the fuel pump a mixture of heating oil and gasoline at a desired ratio and which is mixed just ahead of the fuel pump;

DETAILED DESCRIPTION OF THE INVENTION

For maintaining the aur/fuel ratio approximately at the theoretical value, which is one of the objects of the present invention, it is necessary to raise the fuel supply pressure to a level such that turbulence will develop at the throttle (e in FIG. 1) of the fuel jet port; and the pressure should be raised in proportion to the air velocity head.

The theoretical manner of achieving this will be described with reference to FIG. 1.

If the area of the throttle e is $a_3$, the pressure difference across the throttle is $\Delta P_3$, the specific gravity of the fuel is $\rho t$, the area of the Venturi V is $a_2$, the dynamicstatic pressure difference is $\Delta P_2$ and the specific gravity of air is $\rho a$, the fuel flow $a_3V_3$ at the throttle and the air flow $a_2V_2$ at the Venturi will be respectively;

$$a_3V_3 = Ca_3\sqrt{2g\Delta P_3/\rho t}$$

$$a_2V_2 = a_2\sqrt{g\Delta P_2/\rho a}$$

where $g$ is the acceleration due to gravity and C is a flow factor which is constant in the working range. If $\sqrt{\Delta P_3/\Delta P_2}$ is constant, then the air/fuel ratio $a_2V_2/a_3V_3$ will be constant regardless of the air flow. Therefore, depending on the profile of the throttle e, a specific range of the values of C has only to be determined. Theoretically, however, the air/fuel ratio can be maintained constant regardless of the air flow, by making the Reynolds number of the fuel flow equal to that of the air flow.

The present inventor, having in mind that in a volume type pump such as a known gear pump or screw pump the pressure drops with an increase in the flow rate, has discovered that a fuel supply system satisfying the above requirements can be achieved by an arrangement in which a variable throttle is positioned midway in a conduit connecting the discharge side and the suction side of the volume type pump and the fuel supply pressure can be raised in proportion to the air velocity head.

Figure 2A:
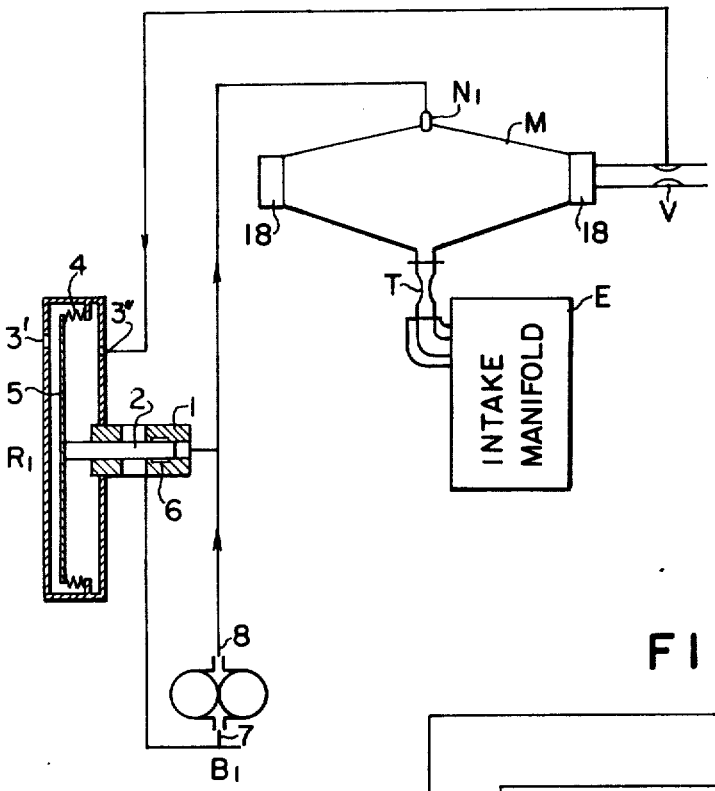
FIG. 2(*a*) is a schematic front elevation view showing a first embodiment of the present invention.
Figure 2B:
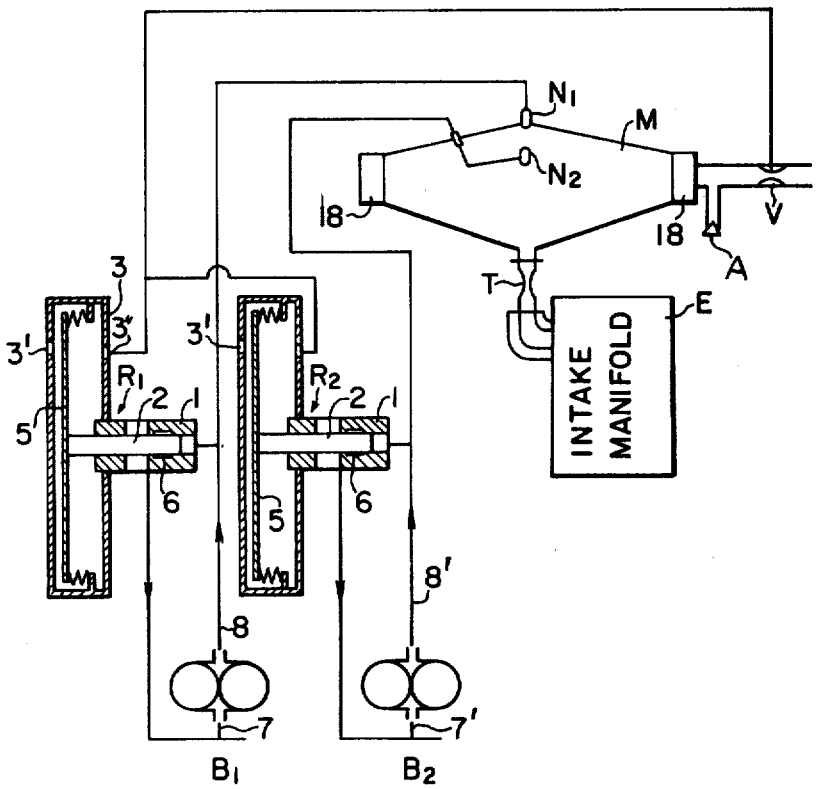

In FIG. 2(*a*) is illustrated a fuel supply system according to the present invention based on the above discovery.

In FIG. 2(*a*), $B_1$ denotes a volume type pump such as a gear pump in which the pressure drops with an increase in the flow rate of the pump. A pressure adjusting device $R_1$ provided with a variable throttle is provided in a conduit between the discharge side 8 and the suction side 7 of the pump $B_1$. Said device $R_1$ is so adjusted that the ratio of the differential pressure between atmospheric pressure and the pressure measured by an air flow measuring mechanism provided in the air path into the engine and the pressure on the discharge side of the fuel pump is equal to n. Said variable throttle is regulated by said pressure adjusting device $R_1$ and the value of n is so set that both the fluid in the jet nozzle $N_1$ connected to the discharge side of the volume pump B and the air flow in the Venturi V at the beginning of the suction path in the intake will be equally turbulent. The fluid from the jet nozzle $N_1$ goes directly into the mixing chamber M, while the air sucked through the Venturi V is drawn into the mixing chamber M, passing through an air filter 18, such as a screen provided around the mixing chamber M, if an air filter is present. Then the mixture is supplied to the intake manifold E through a throttle valve T which promotes the mixing of fuel and air.

In a needle valve which is conventionally used as a variable throttle for fuel, the flow rate changes widely at the slightest movement of the valve; and if it is at an unstable position, the valve causes an on-off flow.

In view of this situation, the present inventor has provided a mechanism, which is fully described below, which has as the variable throttle a tiny annular gap of a specific length 6 between the piston rod 2 and the cylinder 1, and the length of said gap along the piston rod 2 is controllable. By the adjustment of the length of said tiny gap, across which is a large differential pressure, by this mechanism, the stroke of the piston rod can be increased and a stable control can be achieved. If the fuel flow in the jet nozzle $N_1$ is to be made as turbulent as the air flow in the Venturi V, the value of n, i.e., the ratio of the differential pressure between atmospheric pressure and the pressure measured by the air flow measuring mechanism and the pressure on the discharge side of the fuel pump will have to be, say, in the range 500–1000/l, and accordingly the ratio of diameters of the pressure receiving parts in the pressure adjusting device will have to be 20–30/l. When this is done in one step by making the diameter of the low-pressure receiving part 250 mm, the diameter of the high-pressure receiving part will have to be 8–10 mm. In the conventional system, pressure adjustment at such a high ratio would be extremely difficult. As described later in detail, the present invention accomplishes such adjustment with high precision by a purely mechanical arrangement.

The apparatus of the present invention can be modified to mix water with the fuel. Such a modification is shown in FIG. 2(*b*), in which two sets of elements, each consisting of a volume type pump B and a pressure adjusting device R are connected in parallel, the discharge side 8 of one pump $B_1$ directing the fuel through the jet nozzle $N_1$ and the discharge side 8' of the other pump $B_2$ directing the water through the jet nozzle $N_2$, respectively into the mixing chamber M. The fuel and the water are supplied at the same pressure to the mixing chamber M and after being blended with the air from the Venturi V, they are delivered to the suction manifold E. Thus a constant air/fuel ratio can be kept over a wide range of engine speeds and outputs and the fuel which is well atomized and uniformly blended with air, is sucked into the engine cylinders.

Figure 3:
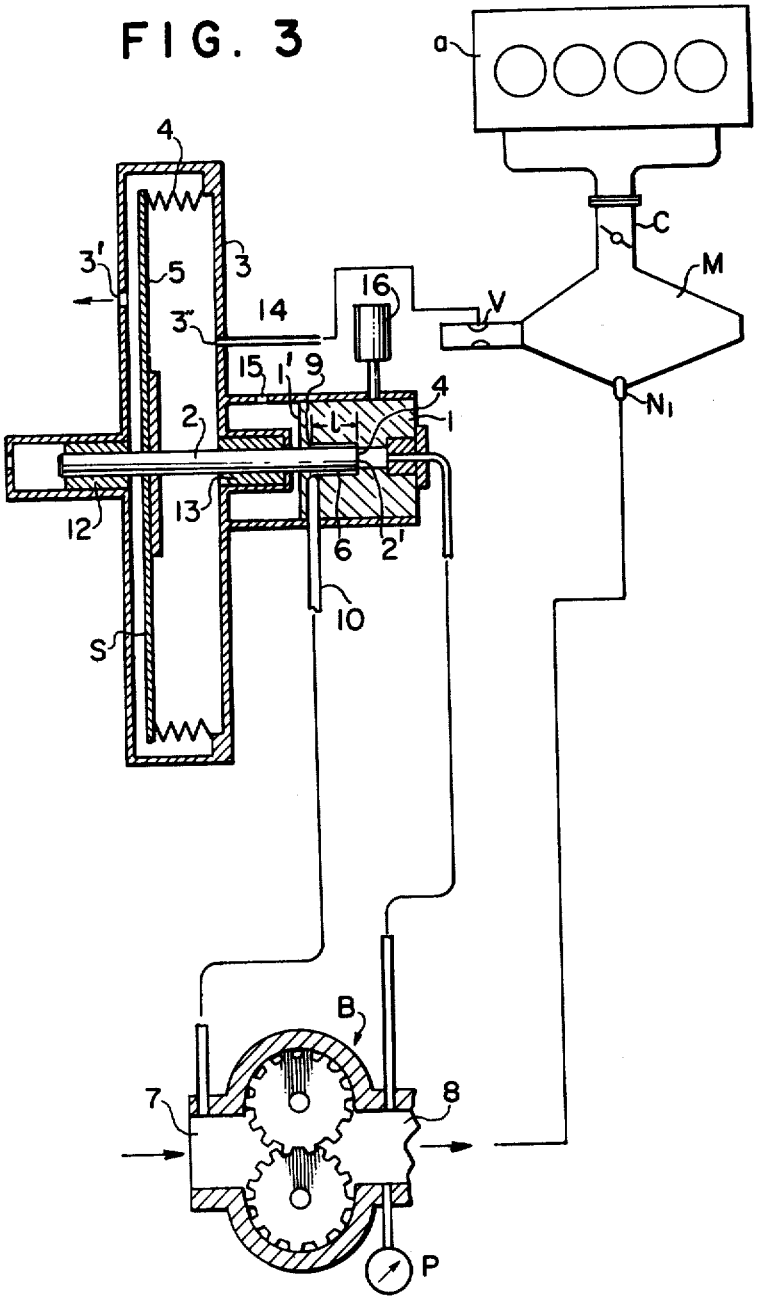
FIG. 3 is a partial sectional front elevation and partly schematic view of the first embodiment shown in FIG. 2(*a*)
Figure 4:
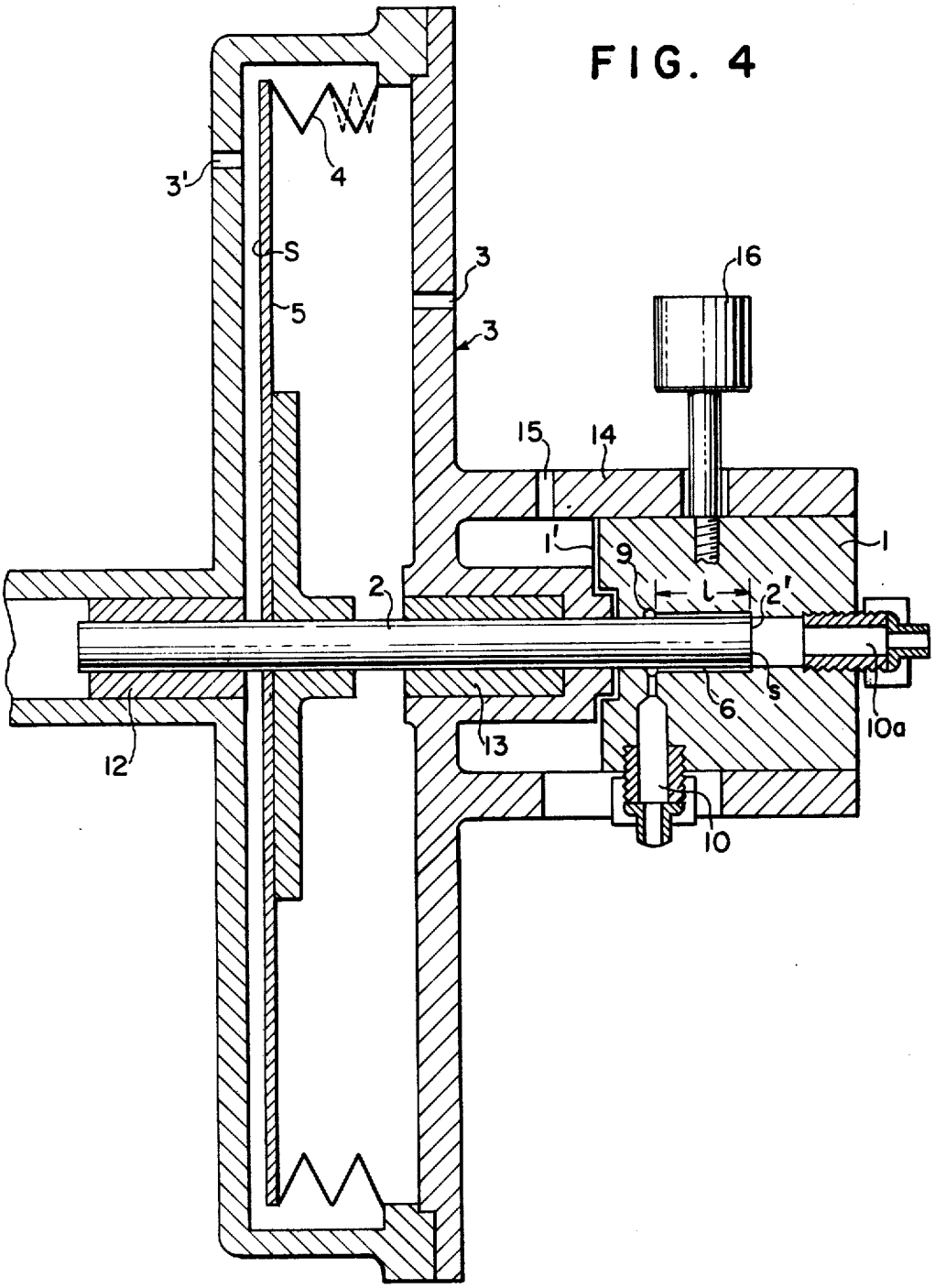
FIG. 4 is an enlarged sectional view of the pressure adjusting mechanism shown in FIG. 3.

FIGS. 3 and 4 show the details of the pressure adjusting device $R_1$ shown in FIG. 2.

A piston rod 2 is slidable in a cylinder 1 and the outer end of said piston rod 2 is fixed to the bellows plate 5 of a bellows 4 in a bellows chamber 3 integral with said cylinder 1. The cylinder has an enlarged diameter portion of length l so that a gap 6 of a predetermined length is left between the piston 2 and the cylinder 1. Said gap 6 communicates with the suction side 7 of the pump B through an annular groove 9 and outlet 10. The inside of the cylinder 1 communicates with the discharge side of the pump B through inlet 10*a*. The space in bellows chamber 3 outside of said bellows 4 communicates via the port 3' with the atmosphere and the inside of the bellows 4 communicates via port 3 with the throat of the Venturi V provided upstream of the suction manifold C of the engine a. The area of the outside S of the bellow plate 5 and the area s of the end 2' of the piston rod 2 are in the relation of $S/s = n$. The discharge side 8 of the pump B communicates with the jet nozzle $N_1$ which discharges into the mixing chamber M. Bearings 12 and 13 support the piston rod 2 with minimum sliding friction. In the above arrangement the bellows 4 which is a component of the pressure adjusting device, is concurrently used as a component of the air flow measuring device together with the Venturi. In the constitution of said air-flow measuring device the square root of the negative pressure of the venturi which pushes the bellow plate 5 is proportional to the air flow.

When the gear pump B is driven, the liquid fuel, (hereafter simply referred to as fuel) is sucked in on the suction side 7 and then discharged at an increased pressure on the discharge side 8. Part of the pressurized fuel acts on the end 2' of the piston rod 2 and part of it, passing through the gap 6, returns to the suction side 7 of the gear pump B via the annular groove 9 and the outlet 10. In the meantime the fuel pressure acting on the end 2' causes the piston rod 2 to be pushed to the left in FIGS. 3 and 4. On the other hand, since a negative pressure is present within the bellows corresponding to the pressure in the Venturi V and the atmospheric pressure acts on the outside of the bellows plate 5, there is produced a rightward force in FIGS. 3 and 4 acting on the piston rod 2 connected with the bellows plate 5. Thus the piston rod 2 is pushed to the right by a force SP, i.e., the product of the differential pressure P between the pressure acting on the outside of the bellows plate 5 and the negative pressure in the bellows and the external area S of the bellows plate 5, and this force tends to increase the length l of the gap 6 around the periphery of the piston rod 2. Meanwhile, a force sP', i.e., the pressure P' acting on the end 2' multiplied by the area s of said end 2', pushes the piston 2 to the left, thereby tending to reduce the length l of the gap around the periphery of the piston rod 2. These two contradictory forces are balanced at a certain point, and at this point (S/s) P, i.e., a pressure nP is acting on the discharge side 8. The flow rate Q of the fuel passing through the gap 6 is expressed by:

$$Q = \frac{\pi}{4\mu} \frac{P - P'}{l} \epsilon^2 r^2$$

where $\mu$ is the coefficient of viscosity of the fluid, $\epsilon$ is the dimension across the gap between cylinder 1 and the piston 2, and r is the radius of the piston rod 2. In practice $\epsilon$ is so small that it is neglected. Thus, for any pressure differential, the flow rate through the gap is proportional to the length l of the gap 6.

Figure 5B:
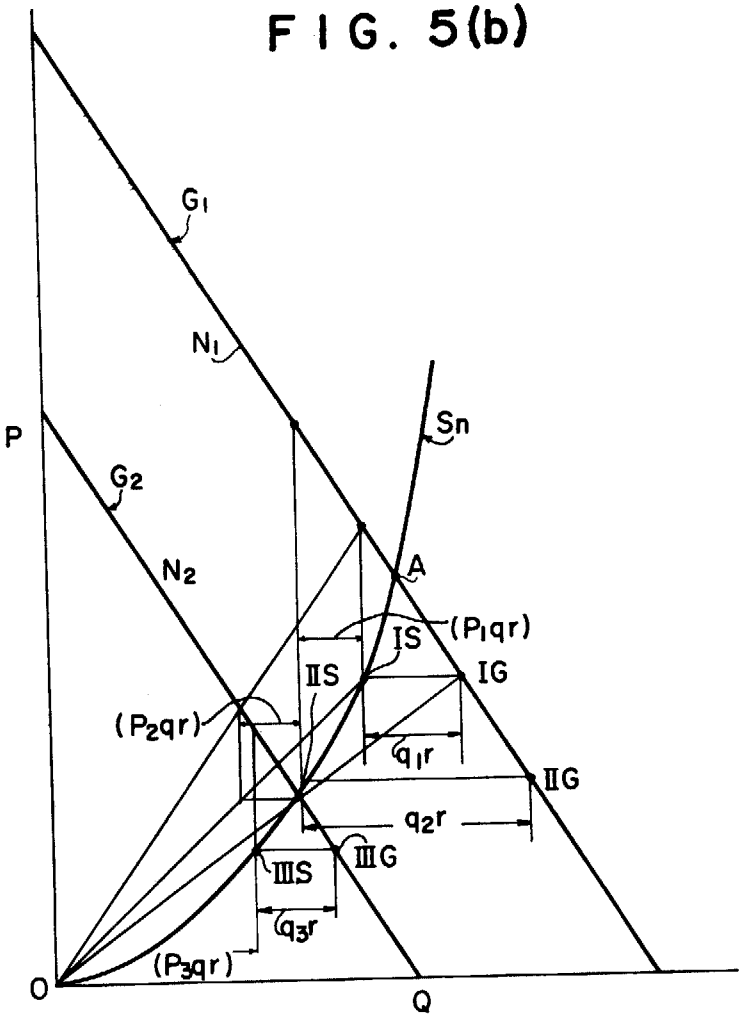
FIGS. 5(*a*) and 5(*b*) are graphs respectively illustrating the effects and function of the present invention.
Figure 5A:
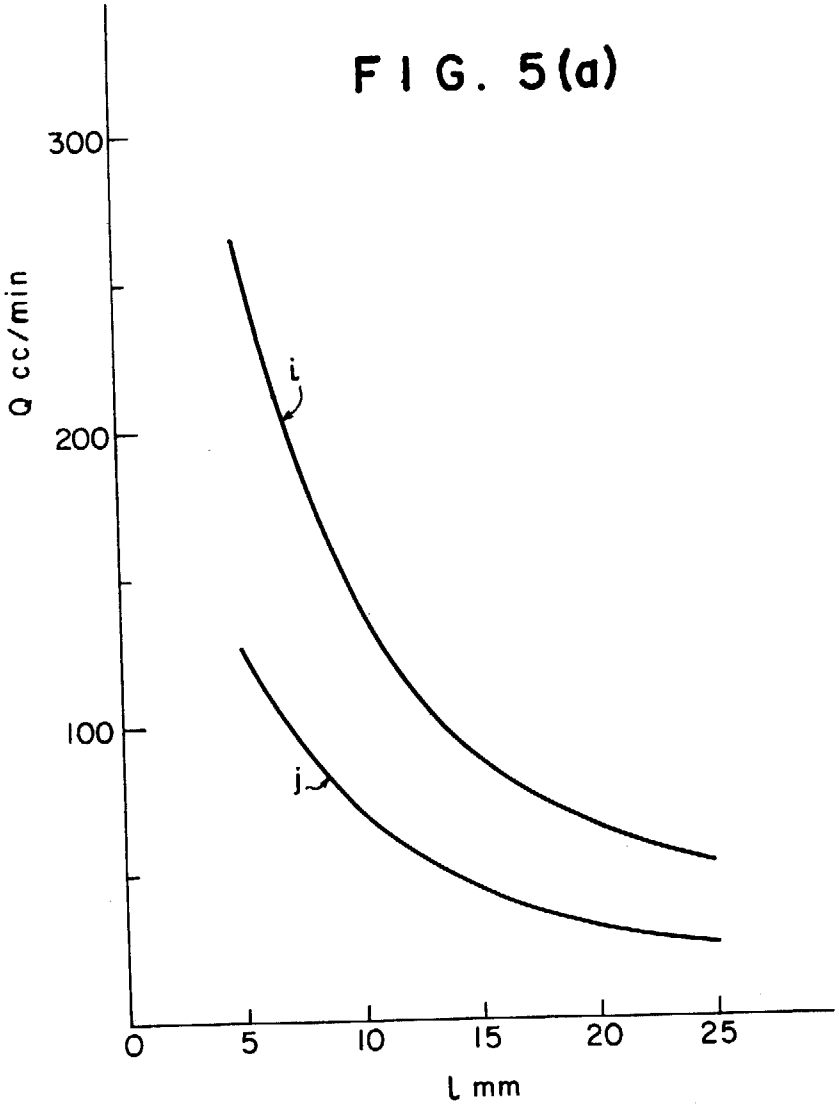

FIG. 5*a* shows some of the experimental results obtained by the present inventor for the above relation.

In FIG. 5*a* the ordinate is the flow rate Q and the abscissa is the length l of the gap 6. The curve i shows the results when $r=5$ mm, $P-P'=12$ kg/cm$^2$, and $\epsilon=1/100$ mm. The curve j shows the results when $r=5$ mm, $P-P'=6$ kg/cm$^2$ and $\epsilon=1/100$ mm.

From the experimental results it is seen that when l decreases, the flow rate through the gap 6 suddenly increases and as a consequence, there is a pressure drop on the discharge side 8 of the pump B and the piston rod 2 moves to the right in FIG. 3; and when l increases, the flow rate through the gap 6 suddenly decreases and the pressure on the discharge side of the pump rises.

The above results will now be explained with respect to the characteristics curves of the gear pump B and the fuel jet nozzle N in FIG. 5*b*.

In FIG. 5*b*, the ordinate is the pressure P and the abscissa is the flow rate Q. The characteristic curves of the gear pump are indicated by $G_1$ and $G_2$, $G_1$ being for a pump rotating at a speed $N_1$ and $G_2$ being for a pump rotating at a speed $N_2$, and the characteristic curve of the fuel jet nozzle is indicated by Sn. When the fuel jet nozzle is connected to the discharge side of the gear pump and the pump is driven at a speed corresponding to the curve $G_1$, the operating point will be at the intersection A of the curve $G_1$ and the curve Sn. If the pump is to be run at a working pressure $P_1$, it will be necessary to start up the pump at the point IG and recycle the flow q1r from the discharge side to the suction side. The working point of the fuel jet nozzle under this condition will be IS. For the running at a working pressure $P_2$, the pump will have to be started up at IIG and the flow q2r will have to be recycled from the discharge side to the suction side. The working point of the fuel jet nozzle under these conditions will be IIS. Even when the pump speed changes from $N_1$ to $N_2$ and the working pressure becomes $P_3$, through similar adjustment of pressure the operating point of the pump is shifted to IIIG and that of the fuel jet nozzle to IIIS.

The jet nozzle conditions described above are selected as follows: the effective diameter of nozzle d is selected such that the Reynolds number $$Re = \frac{vd}{\upsilon},$$

v being the kinetic viscosity of the fuel, of the flow of fuel in the nozzle at velocity $\frac{1}{4}$ and the effective nozzle diameter d is in the turbulent range; a jet nozzle of the type satisfying this d is used: the range in which the flow coefficient of fuel is constant is obtained from the characteristic curve of this nozzle and the range of fuel flow rates: and in the thus obtained range the ratio between the fuel pressure and the velocity head pressure of air in the Venturi is determined.

This ratio must be equal to the pressure ratio n in the pressure adjusting device $R_1$ and the selection of the nozzle and the calculations of the Venturi diameter and the pressure ratio must be repeated until this condition is satisfied.

Specific examples of selecting said jet nozzle conditions are given as follows:

(1) The fuel flow rate f cc/sec is found from the engine output P(hp) and the fuel consumption rate be gr/hp.hr.

$$f = \frac{Pbe}{\rho_f 3600}$$

where $\rho_f$ is the fuel density gr/cc (2) The effective diameter dm of the nozzle throttle and the fuel flow rate Vm/sec at this throttle can be found from $$\frac{\pi d_2}{4} \cdot V = \frac{f}{10^6},$$

where d is provisionally set and therefrom V is found from the following formula:

$$V_f = \frac{4f}{10^6 \pi d_2}$$

(3) Reynolds number is found from the following formula:

$$Re = \frac{v \cdot d}{\upsilon}$$

Possibility of turbulence (over $4\times10^3$) for an output P under light load equal to, say, about $\frac{1}{3}$ of the full load is examined. If there is no such possibility, calculations are repeated with varied d until the above conditions are satisfied.

Figure 6:
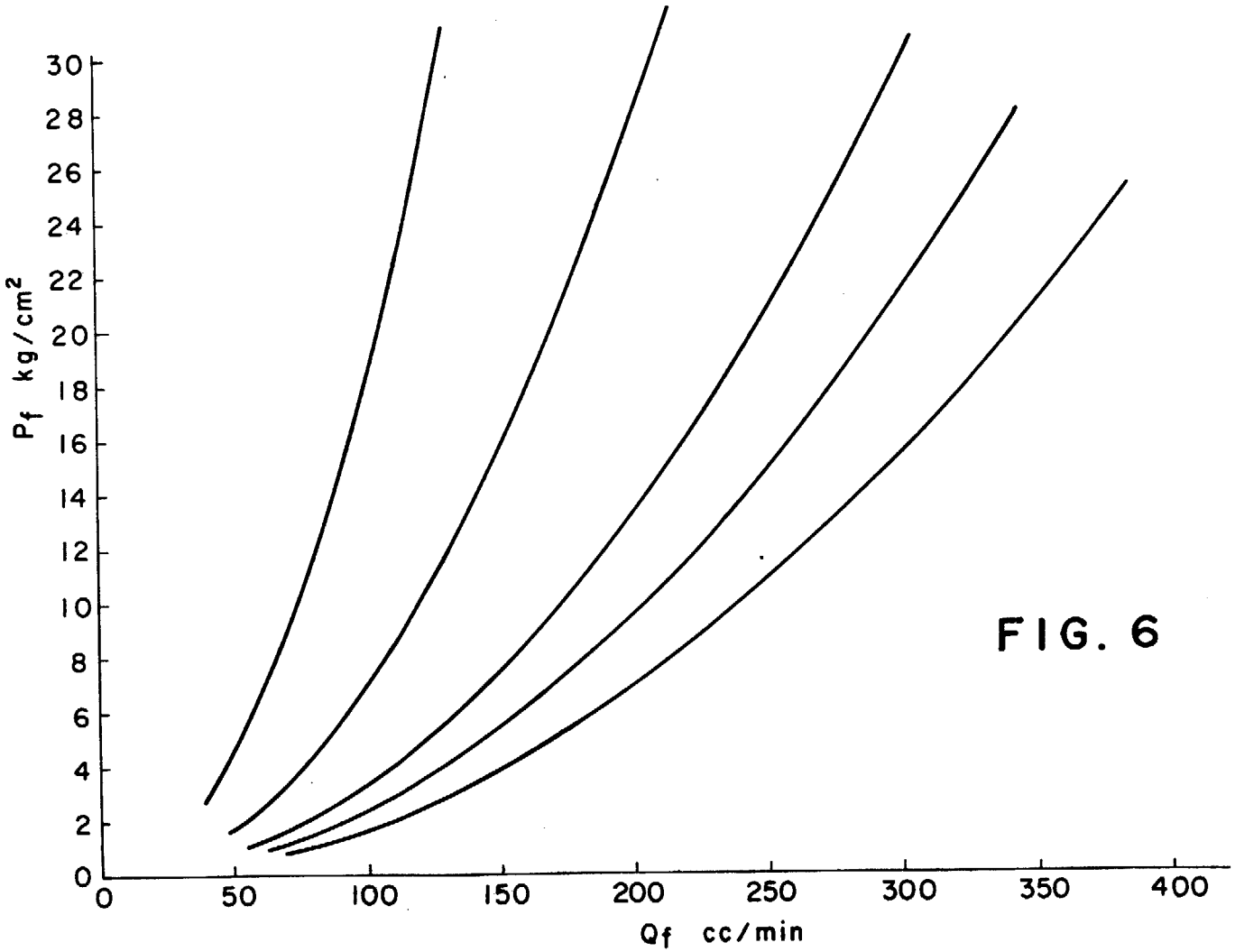
FIG. 6 is a nozzle jet characteristic curve.

(4) Constancy in the flow coefficient of selected nozzle characteristics in the range from full load to light load is verified by the following formula:

$$C^2 = \frac{Qf^2 \cdot f}{2gPf \cdot Af^2 \times 10^3}$$

where Pf is the pressure taken on the ordinate in FIG. 6 and Qf is the jet volume in $m^2$/sec taken on the abssissa in FIG. 6, Af being the sectional area in $m^2$ of the nozzle throttle. FIG. 6 illustrates a nozzle jet characteristic curve, the ordinate being the pressure Pf ($Kg/cm^2$) and the abssissa the jet volume (cc/min).

(5) Sucked air volume Q $m^3$/sec is found from the displaced volume.

The air velocity Va at the venturi is found from the sectional area $Am^2$ of the venturi.

$$Va = \frac{Q}{A}$$

The negative pressure Pa of the venturi due to the velocity head is found as follows:

$$Pa = \frac{\rho a V^2}{2g}$$

(6) The pressure ratio of the pressure adjusting device is found from the following formula under the same engine conditions.

$$\frac{\text{Fuel pressure in nozzle performance curve}}{\text{Negative pressure due to venturi velocity head}}$$

The ratio obtained after these selections and calculations will make it possible to maintain the air/fuel ratio approximately at the theoretical value, permitting a wide range of variations in the amount of air taken into the engine.

Meanwhile the liquid fuel flowing in the gap 6 around the piston rod 2 makes it possible to move the piston rod 2 with a slight force, and because the length is varied by the movement of the piston rod 2, this arrangement permits smooth action of the throttle. Thus a pressure of several hundred mm water column can be magnified 500–1000 times by this simple arrangement.

If in this case, as shown in FIG. 4, the annular groove 9 is provided around the piston rod 2 at the end of the gap 6 near the cylinder end 1' which is closer to the bellows chamber 3, and said annular groove 9 is connected through the outlet 10 to the suction side 7 of the pump, and atmospheric pressure is caused to act on the outside of said cylinder head 1' through an atmospheric communicating port 15 in the casing 14, fuel getting into said annular groove 9 through the gap 6 will not leak to the cylinder head 1', because the pressure in the outlet 10 is lower than on the cylinder head 1'.

Moreover, if a vibrator 16 is installed above the cylinder 1 for vibrating said cylinder 1, the cylinder 1 will be vertically vibrated and friction between inside of the cylinder 1 and the outside of the piston rod 2 will be minimized, thereby enhancing the accuracy of the pressure adjusting device. A horizontal vibration will also be able to mitigate the friction but a vertical one will be more effective.

Figure 7A:
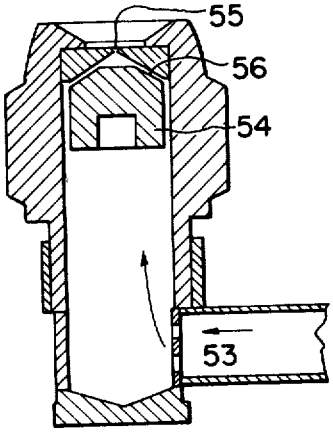
FIG. 7(a) PRIOR ART
FIG. 7*a* is a sectional elevation view illustrating a known swirl flow type nozzle.
Figure 7B:
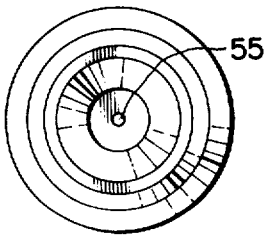
FIG. 7(b) PRIOR ART
FIG. 7*b* is a plan view of the nozzle of FIG. 7*a*.

If in the above examples, a swirl flow type nozzle as shown in FIG. 7 is used for nozzle $N_1$, a better effect will be obtained, because good atomization will be attained at a relatively low pressure, resulting in satisfactory mixing of fuel and air, uniform distribution of the fuel to each cylinder and combustion at a lean air/fuel ratio. The swirl type nozzle is known in the prior art, and one example of the construction thereof is illustrated in FIG. 7. The liquid is delivered at high pressure from the inlet port 53 in the direction of the arrow. Said pressurized liquid flows in the direction of the arrow through the nozzle, passing between the guide 54 and the inner wall of the nozzle. It is discharged in a spray from the opening 55 after flowing through grooves 56 in the guide 54. The pressurized liquid, which is formed into a thin-conical film in the grooves, is centrifugally ejected from the opening 55 as a fine spray.

If the longitudinal axis of the piston rod 2 in the pressure adjusting device $R_1$ is positioned parallel to the direction of travel of a vehicle having the engine mounted therein, the fluctuation in the fuel density due to vertical vibration during running of the vehicle will be avoided. If the axis of the piston rod 2 is normal or perpendicular to the running direction, the fuel density will fluctuate due to vertical vibration during the time the vehicle is running and as a consequence the operation of the apparatus is likely to be disturbed. The above-described arrangement can eliminate such disturbance.

If the low pressure side of the pressure adjusting device $R_1$ faces in the direction of movement of the vehicle, a component of force due to the weight of the plunger will increase the fuel pressure when a vehicle in which the apparatus is mounted is ascending a slope, thereby producing a rich mixture and conversely when the vehicle is descending a slope a lean mixture will be produced.

Figure 8A:
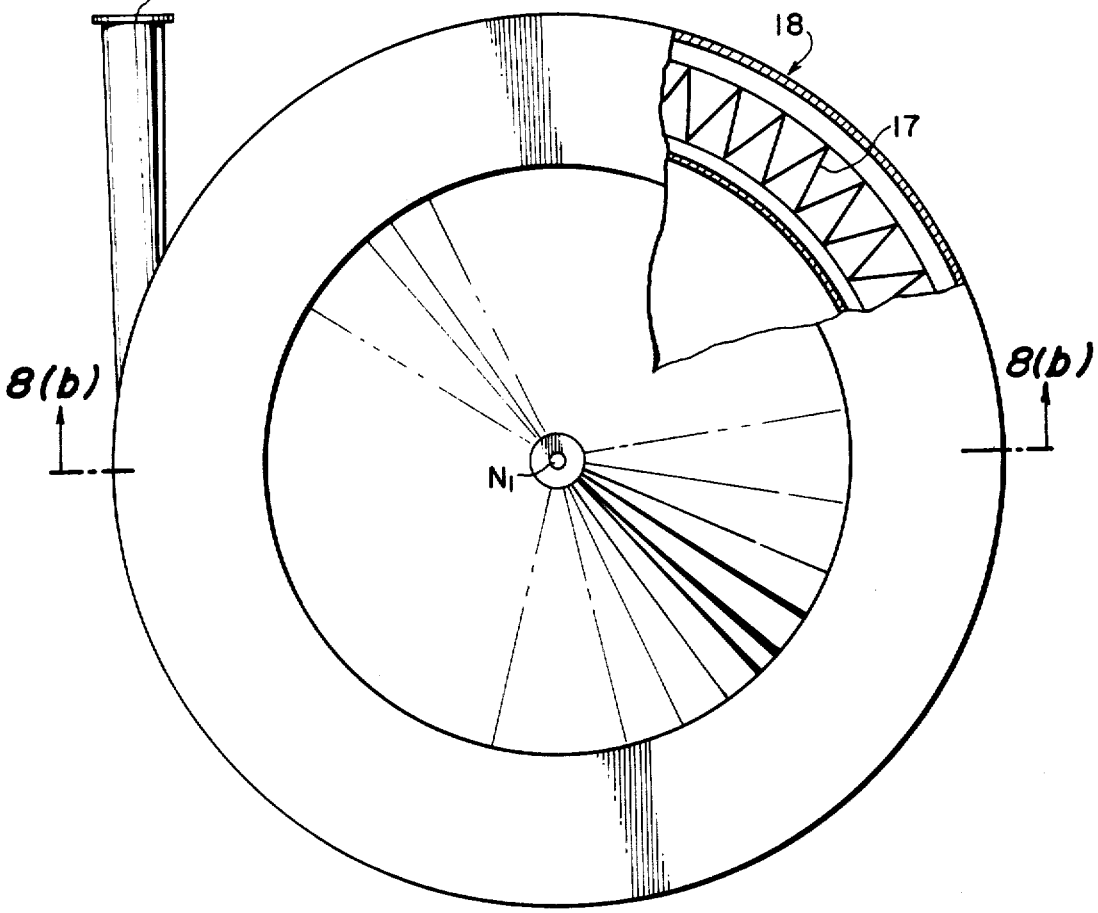
FIG. 8(*a*) is a plan view of a mixing chamber which can be used in the present invention.
Figure 8B:
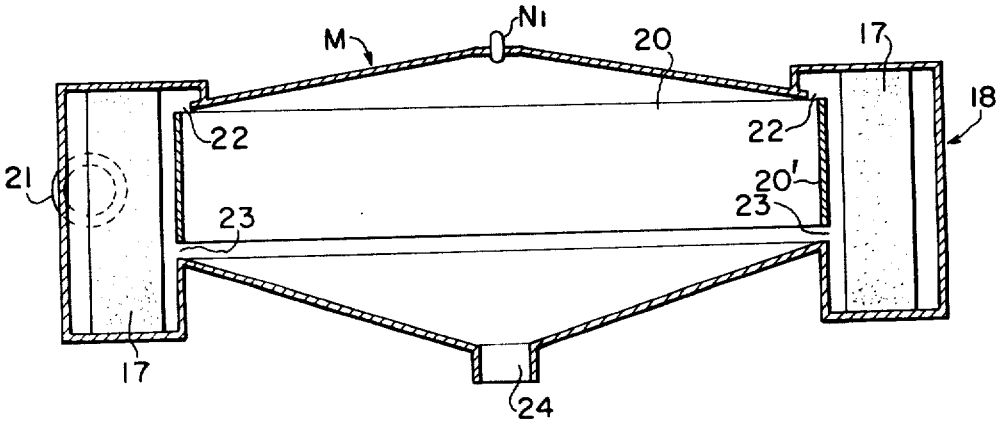
Figure 9A:
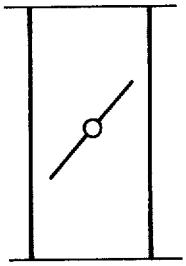
FIG. 9(a) PRIOR ART
FIG. 9(*a*) is a schematic front elevation view of a conventional suction throttle.
Figure 9B:
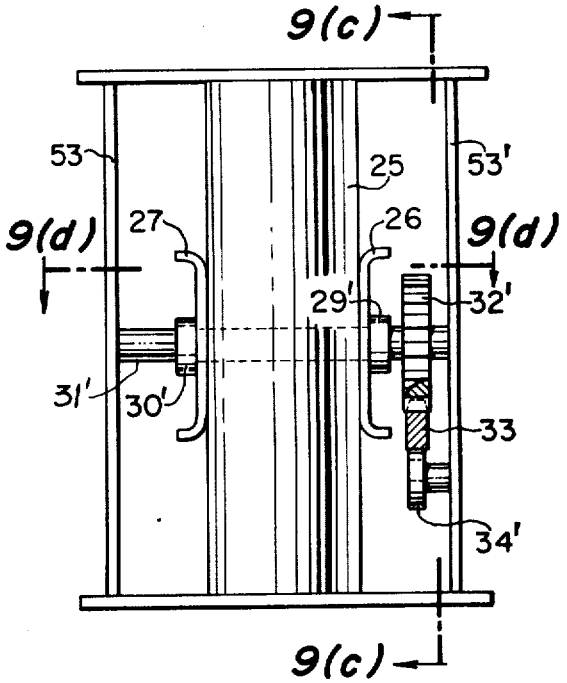
Figure 9C:
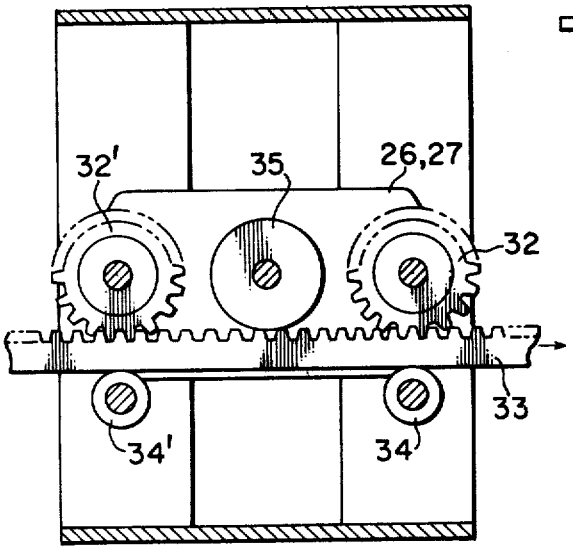
Figure 9D:
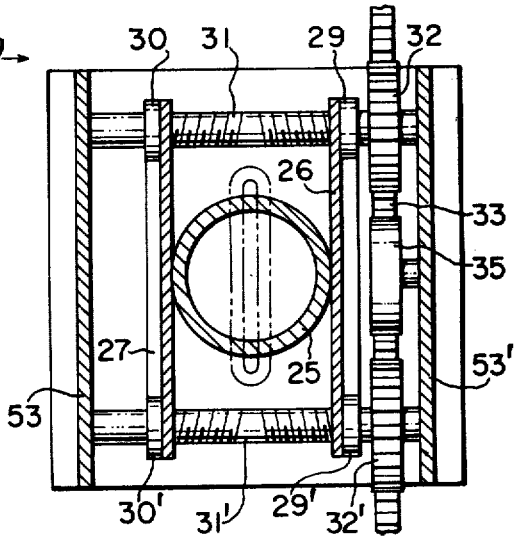
Figure 9E:
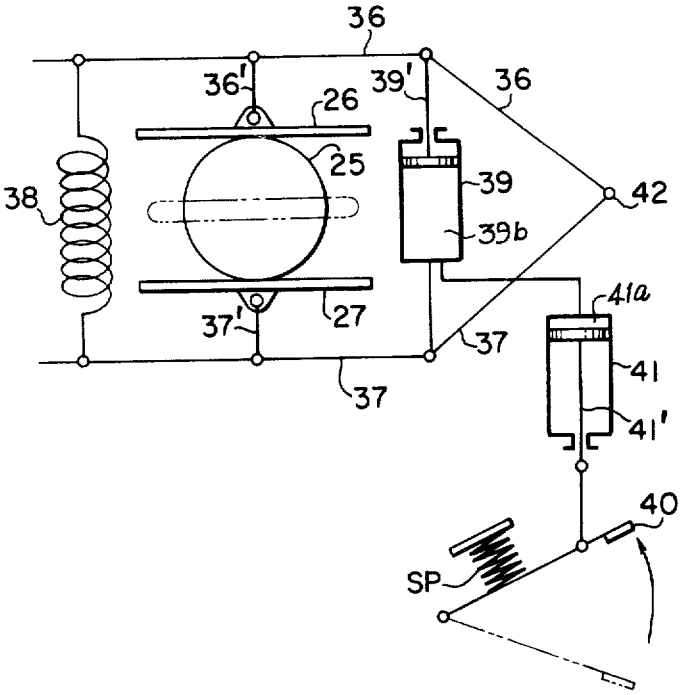
Figure 9F:
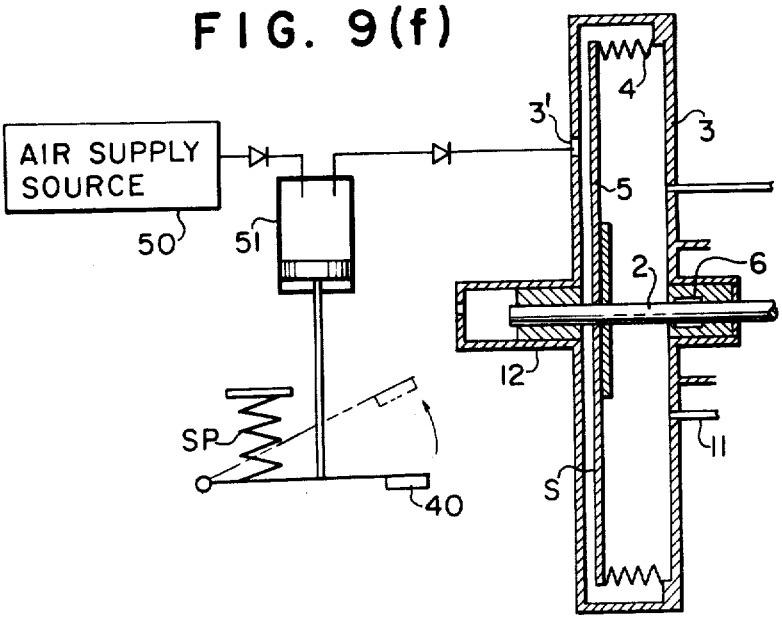
Figure 9G:
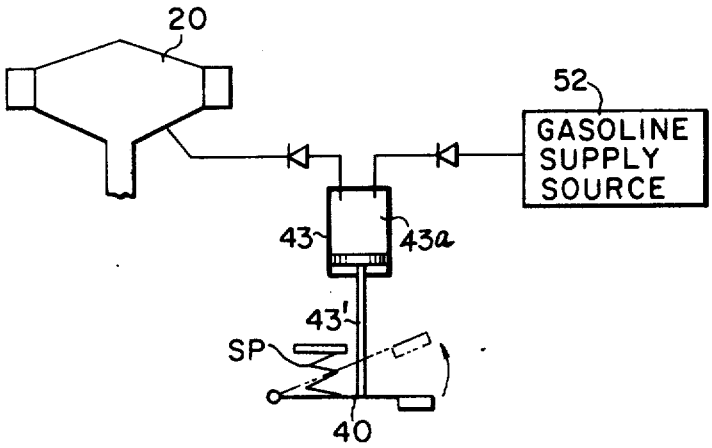
Figure 9H:
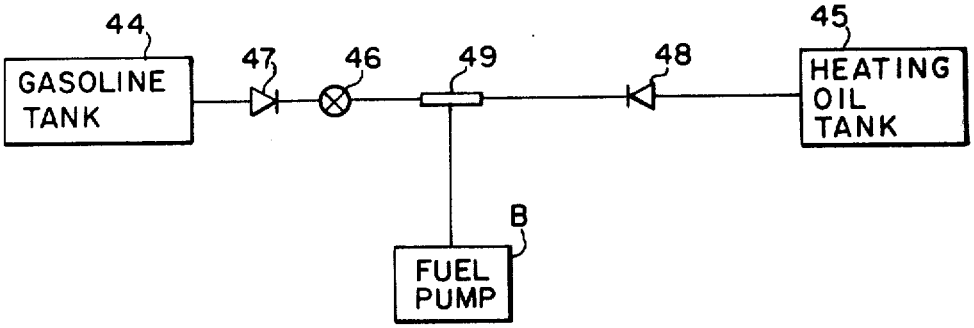

FIGS. 8(*a*) and 8(*b*) illustrate a preferred construction of the mixing chamber for the apparatus according to the present invention. The mixing chamber 20 is cylindrical in form and tapers toward both ends and an annular chamber 18 therearound has an annular filter 17 therein separated from the chamber 20 by the partition wall 20'. The air admitted through the suction port 21 flows into said filter 17 wherein dust is removed as it passes through said filter 17. The filtered air then passes through the annular openings 22 and 23 at the top and bottom of the partition walls 20' and enters the mixing chamber 20. After the air mixes with the fuel introduced through the jet nozzle $N_1$, the mixture is delivered from the outlet 24 to the intake manifold E via the throttle valve T.

This construction of the mixing chamber M is preferred because a desirable mixture of clean air and fuel can be obtained from a compact unit which makes efficient utilization of space. In the present invention, however, provision of the annular filter 17 is not essential and the objects of the invention may be attained without any such filter.

FIGS. 9(*b*)–9(*d*) illustrate a preferred throttle valve T for positioning between the mixing chamber M and the intake manifold E. A flexible tube 25 extends between parallel throttle plates 26 and 27 and the central internal surfaces of the plates contact the external surface of said flexible tube 25 along lines parallel to the axis of the tube. At both ends of said throttle plates 26 and 27 are respectively fitted right hand threaded nuts 29 and 29' and left hand threaded nuts 30 and 30'. Both ends of the shaft of threaded rods 31 and 31' are rotatably mounted in the fixed side plates 53, 53'. Threaded rods 31, 31' are positioned perpendicular to said throttle plates 26 and 27 and are spaced from each other on opposite sides of the tube 25, and said rods are threaded through the nuts 29 and 29' and said nuts 30 and 30'. To one end of the rods 31 and 31' are attached pinions 32 and 32' which mesh with a rack 33 extending parallel to said plates. Rollers 34 and 34' and a rubber roller 35 are guide rollers for guiding the rack 33. The ends of shafts of the rollers 35, 34 and 34' are rotatably mounted on the fixed side plate 53'. When the rack 33 is driven in the direction of the arrow, the pinions 32 and 32' interlocked therewith turn and cause the rods 31 and 31' to turn in the appropriate direction. Since nuts 29 and 29' have right hand threads and nuts 30 and 30' have left hand threads, the movement of the rods 31 and 31' causes the throttle plates 26 and 27 to move closer together, thereby pushing the corresponding outside surfaces of said flexible tube 25 radially inwardly and reducing the cross-sectional area of the flexible tube 25. The lengths of the throttle plates 26 and 27 in the axial direction of the flexible tube are larger than the outside diameter of the flexible tube, so that the length of the collapsed portion of the flexible tube 25 is larger than the outside diameter of the tube and accordingly the velocity of the gas flow is increased as the throttling action is increased. Thus, any fuel deposited on the internal wall of the flexible tube will be torn off the wall by the increased velocity flow and will be suspended as fine particles in the gas. The broken line in FIG. 9(*d*) shows the shape of the flexible tube 25 when it has been collapsed to a maximum by the throttle plates 26 and 27.

In the butterfly valve illustrated in FIG. 9(*a*) which is conventionally used as a throttle for controlling the air fuel mixture sucked into an internal combustion engine, the mixture of air and fuel droplets hits against the valve plate and the fuel droplets separate and are deposited on the wall of the conduit near the valve. These droplets flow down the suction conduit wall and satisfactory mixing of the air and fuel cannot be assured. Adoption of the throttle as illustrated in FIGS. 9(*b*)–9(*d*) will change any fuel deposited on the wall of tube 25 into fine particles and together with the effect of the jet nozzle will make possible combustion at a lean air/fuel ratio, thereby making it possible to use heating oil as fuel and assuring stable operation even at low load.

Said throttle may also be constructed as illustrated in FIG. 9(*e*). By pushing on an accelerator pedal 40 in the direction of the arrow against the force of spring SP the piston and rod 41' of the cylinder 41 connected to said accelerator pedal 40 moves into the cylinder and sends hydraulic fluid in the chamber 41*a* of the cylinder 41 into the chamber 39*b* of the throttle cylinder 39, thereby moving the rod 39' out of cylinder 39 and increasing the gap between the links 36 and 37 pivoted around a pin 42. As a result the gap between the throttle plates 26 and 27 connected respectively by connecting members 36' and 37' to the links 36 and 37 is also enlarged, and thus the throttling action of the plates 26 and 27 on the flexible tube 25 is lessened. When the pressure on accelerator pedal 40 is released, the oil in the chamber 39*b* of the throttle cylinder 39 is drawn into the chamber 41*a* of the cylinder 41 and the force of a tension spring 38 having a predetermined spring constant and which is connected between the links 36 and 37 draws the throttle plates 26 and 27 closer together, whereby the flexible tube 25 is collapsed by the throttle plates 26 and 27 and as indicated by the broken line. Thus, in the arrangement illustrated in FIG. 9(*e*), the flexible tube can be throttled or opened in response to the pushing or release of the accelerator pedal 40 and accordingly the flow of the air-fuel mixing in the throttle can be effected simply and efficiently.

As shown in FIG. 9(*f*), the atmospheric side of the bellows 4 in the pressure adjusting device can for instance, be connected to an air supply source 50 through an accelerator piston-cylinder 51, the accelerator pedal 40 being connected to the piston rod thereof. When the accelerator pedal 40 is pushed in the direction of the arrow against the force of the spring SP, air will be introduced at the atmospheric side of the bellows, the differential pressure on the low pressure side of the pressure adjusting device will increase, and consequently the fuel pressure will also increase, thereby causing engine acceleration.

Engine acceleration can also be accomplished by the arrangement illustrated in FIG. 9(*g*). When the accelerator pedal 40 is pushed in the direction of the arrow against the force of the spring SP, the rod and piston 43' of the cylinder 43 move into the cylinder and the gasoline which has previously been drawn from gasoline supply source 52 into the chamber 43*a* of the cylinder 43 is forced into the mixing chamber 20, whereby the engine can be accelerated smoothly. Further, if a bypass is provided around the Venturi V provided at the entrance to the air intake system and an air/fuel adjusting device having a throttle valve is provided in said bypass, an action similar to choking can be caused to take place and the air/fuel ratio can be controlled as desired. For instance, as shown in FIG. 2(*b*), and air supply source can be connected to an auxiliary air port A in the conduit between the Venturi V and the mixing chamber M so that the air can be introduced through said auxiliary air port A into said conduit and if means for controlling the introduction of air is provided in the driver's seat of the vehicle on which the the apparatus is mounted, an action similar to choking can be achieved and the air/fuel ratio can be controlled as desired.

It is also preferable to provide an exhaust gas jacket around the air intake pipe so that said pipe can be heated, or a part of the wall of said pipe can be made thicker to prevent a sudden cooling of said pipe.

Further, if two volume type pumps B and pressure adjusting devices R are arranged in parallel, such as pump $B_1$ and pressure adjusting device $R_1$ and pump $B_2$ and pressure adjusting device $R_2$ in FIG. 2(*b*), fuel can be supplied from the discharge side of the pump $B_1$ and water can be supplied from the discharge side of the pump $B_2$ to the mixing chamber M through the jet nozzles $N_1$ and $N_2$, respectively. By the selection of appropriate jet nozzles $N_1$ and $N_2$ and pressure ratios $n_1$ and $n_2$ for the pressure adjusting devices, the fuel/water ratio can be set at a constant optimum value.

With such an arrangement fuel consumption can be reduced and at the same time the temperature of combustion can be lowered, thereby reducing the generation of NOx.

Figure 10:
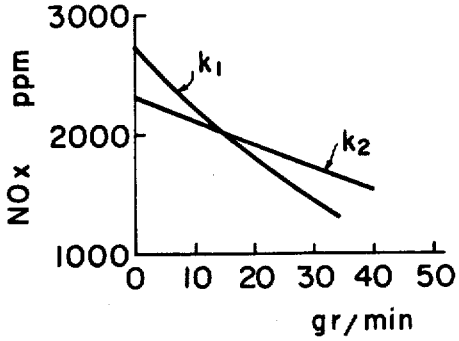
FIG. 10 is a graph illustrating the effect of the water/fuel ratio on the NOx concentration in the exhaust gas from the engine equipped with apparatus according to the present invention.

FIG. 10 illustrates the relation between the volume of added water and NOx in the exhaust gas. In FIG. 10 the abscissa is the volume of added water in gr/min and the ordinate the NOx concentration in the exhaust gas in ppm, curve $k_1$ being for gasoline alone being supplied as fuel at the rate of 112 cc/min and curve $k_2$ being for gasoline and heating oil mixed in equal proportions and being supplied at the rate of 115 cc/min.

From FIG. 10 it is apparent that NOx generation can be reduced by the selection of an appropriate water/fuel ratio. If both nozzles $N_1$ and $N_2$ are, as shown in FIG. 2(*b*), arranged on the central axis of the air filter in the mixing chamber M, the mixing of fuel, water and air will be satisfactory and combustion at a lean air/fuel ratio will be possible. Thus fuel consumption will be reduced and satisfactory operation will be obtained even when using heating oil instead of gasoline. As mentioned above, the heating oil to be used in the present invention is "Kerosene" which has a flash point over 40° C., an initial boiling point over 150° C. and an end point below 240° C. Experimental results obtained by the present inventor show that an effect which is about the same as using gasoline alone can be achieved when heating oil is mixed with 10–40% by volume of gasoline. If instead of premixing the heating oil with gasoline, the heating oil and gasoline can be blended just ahead of the fuel pump and the mixture delivered to the fuel pump with the mixing ratio adjusted to the running conditions, operation at the optimum mixing ratio can then be achieved. An arrangement for accomplishing this is illustrated in FIG. 9(*h*), in which a gasoline tank 44 is connected through a check valve 47 and a needle valve 46 to one branch of a T-joint 49, while a heating oil tank 45 is connected through a check valve 48 to the other branch of the T-joint 49, the output side of the T-joint 49 being connected to the input side of the fuel pump B. Means can be provided for controlling the operation of the needle valve 46 from the driver's seat of the vehicle in which the apparatus is mounted, so that it becomes possible to supply the fuel pump B with a mixture of heating oil and gasoline at the desired mixing ratio.

To verify the effect of the present invention, the present inventor carried out experiments. Some of the experimental data are described below.

Figure 1:
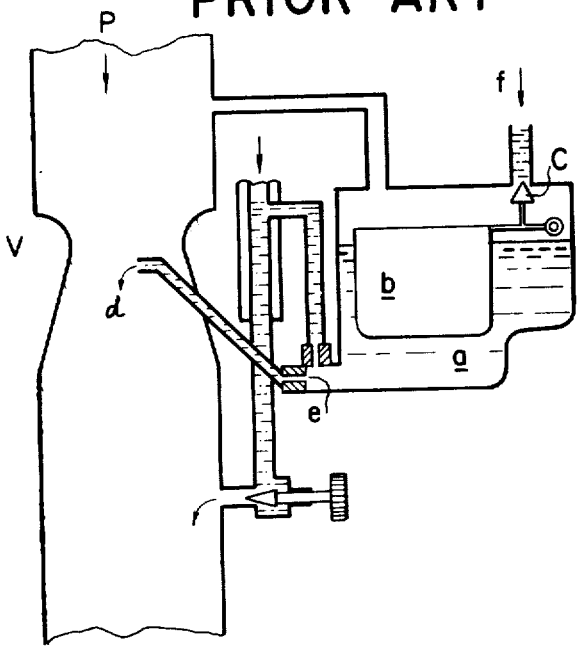
FIG. 1 PRIOR ART
FIG. 1 is a schematic section illustrating a conventional simple carburator.
Figure 11:
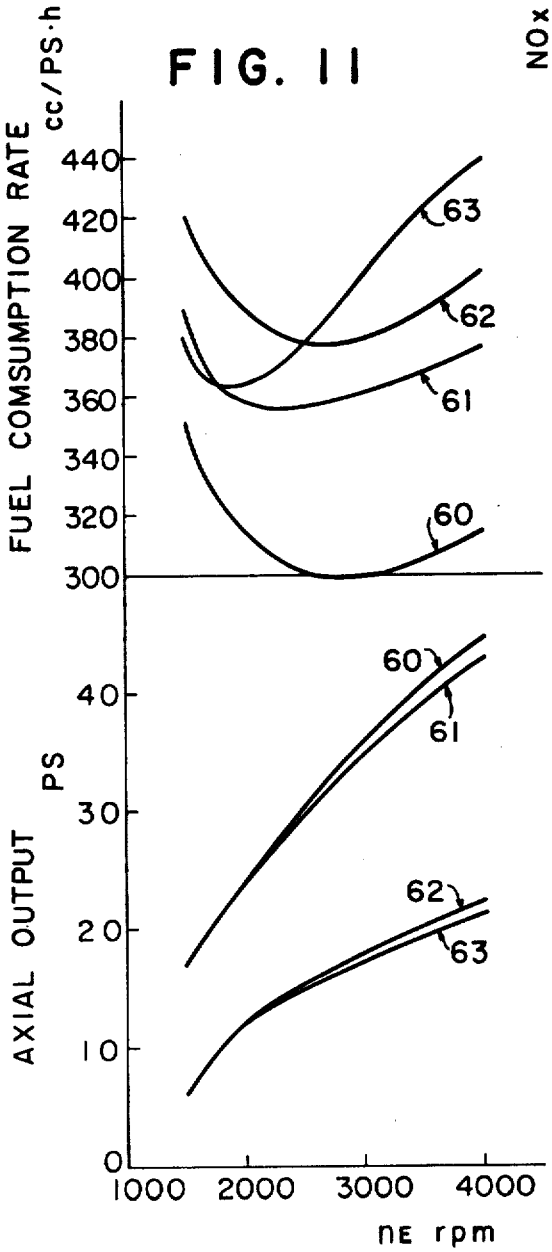
FIGS. 11, 12(*a*) and 12(*b*) are graphs illustrating the results of experiments carried out using the apparatus and method of the present invention.

FIG. 11 shows some of the experimental results for comparison of the performance of the present invention and the conventional system of FIG. 1.

In FIG. 11 the abscissa is the engine speed, while the ordinate shows the output and the fuel consumption rate, curves 60 being for a full engine load controlled by the apparatus of the present invention, curves 61 being for a half engine load controlled by the apparatus of the present invention, curves 62 being for a full engine load controlled by the conventional system and curves 63 being for a half engine load controlled by the conventional system.

Figure 12A:
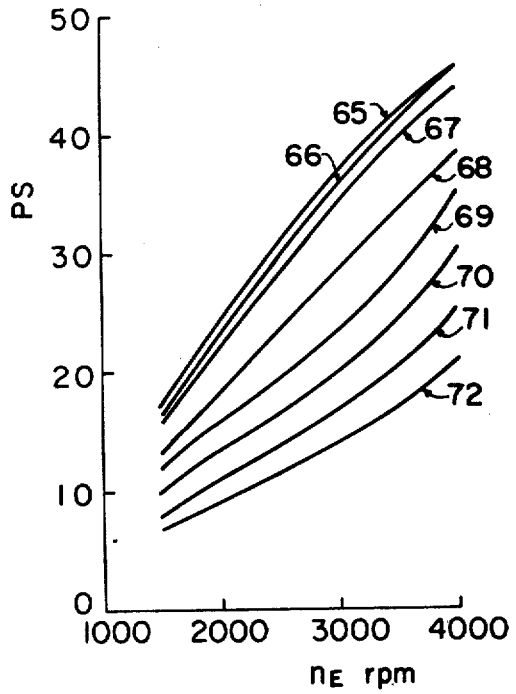
Figure 12B:
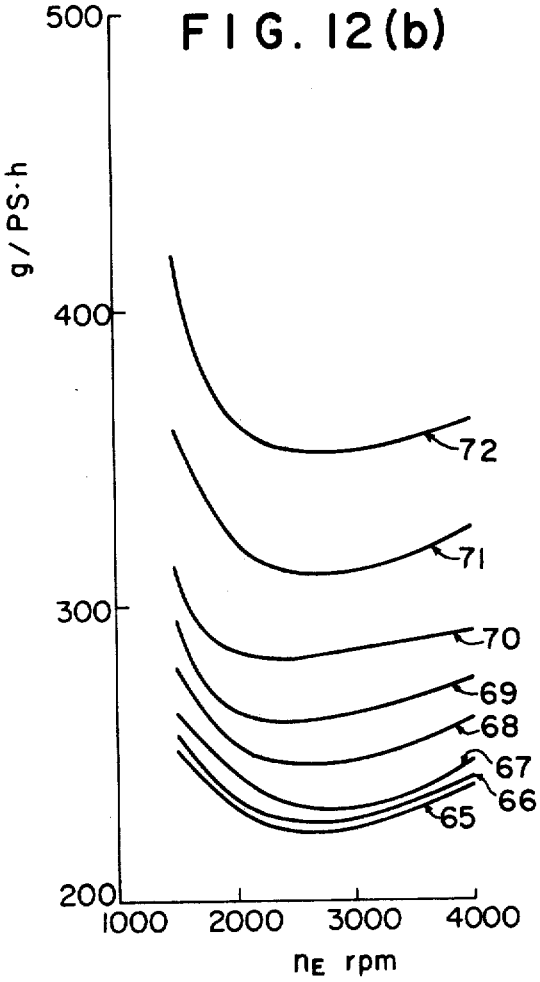

FIGS. 12*a* and 12*b* are characteristic curves obtained when a mixture of gasoline and heating oil is used and the engine is controlled by an apparatus according to the present invention and the mixing ratio is varied. As the proportion of heating oil increases, knocking is liable to occur. The critical output at which knocking ceases is illustrated in FIG. 12(*a*), in which the ordinate is the limit of knock-free output and the abscissa is the engine speed.

The fuel consumption for the examples of FIG. 12(*a*) are shown in FIG. 12(*b*), in which the ordinate is the fuel consumption rate for the limit of knock free output and the abscissa is the engine speed. The curves 65–72 are respectively for the percentages of gasoline in the gasoline-heating oil mixture of 100, 90, 80, 60, 50, 40, 20 and 0.

As is evident from the foregoing data, according to the present invention, when both the fluid flow in the jet nozzle connected to the discharge side of the pump and the air flow in the Venturi can be made equally turbulent at the same time, regardless of a wide variation in the volume of sucked air, the air/fuel ratio can be kept at approximately the theoretical value, resulting in the advantages that good atomization is attained due to the fuel being sprayed at high pressure, which in turn results in satisfactory blending of fuel and air, combustion at a lean air fuel ratio, and ability to use heating oil and still obtain efficient combustion with an economical, safe fuel with a low ignition point.

What is claimed is:

1. A pressure adjusting device for a fuel supply apparatus for a spark ignition type of internal combustion engine, said apparatus comprising: a cylinder, a piston slidable in said cylinder, said cylinder having an inlet opening into the inner end thereof for admitting liquid fuel from the discharge side of a fuel pump, said piston and cylinder having a small gap therebetween extending along a portion of the length thereof with the length of the gap being varied during motion of the piston in and out of the cylinder, said cylinder having an outlet therefrom at the end of the gap remote from the inlet for discharging liquid fuel passing through said gap to the intake side of a fuel pump, a bellows at the opposite end of said piston from said gap and having a bellows plate attached to the said opposite end of said piston, the space outside of said bellows being open to the atmosphere, and means connected to said bellows for communicating the interior of the bellows with the static pressure of a Venturi throat in the air intake of the fuel supply apparatus.

2. In combination, a vehicle having a spark ignition type internal combustion engine thereon, a fuel supply apparatus for said engine, and a pressure adjusting device for said fuel supply apparatus, said pressure adjusting device having a cylinder, a piston slidable in said cylinder, said cylinder having an inlet opening into the inner end thereof for admitting liquid fuel from the discharge side of a fuel pump, said piston and cylinder having a small gap therebetween extending along a portion of the length thereof with the length of the gap being varied during motion of the piston in and out of the cylinder, the cylinder having an outlet therefrom at the end of the gap remote from the inlet for discharging liquid fuel passing through said gap to the intake side of a fuel pump, a bellows at the opposite end of said piston from said gap and having a bellows plate attached to the said opposite end of said piston, the space outside of said bellows being open to the atmosphere, and means connected to said bellows for communicating the interior of the bellows with the static pressure of a Venturi throat in the air intake of the fuel supply apparatus, said pressure adjusting device being positioned in said vehicle with said piston parallel to the direction of travel of said vehicle and with the bellows facing forward in the vehicle.

3. In combination: a pressure adjusting device for a fuel supply apparatus for a spark ignition type of internal combustion engine, said device comprising a cylinder, a piston slidable in said cylinder, said cylinder having an inlet opening into the inner end thereof for admitting liquid fuel from the discharge side of a fuel pump, said piston and cylinder having a small gap therebetween extending along a portion of the length thereof with the length of the gap being varied during motion of the piston in and out of the cylinder, the cylinder having an outlet therefrom at the end of the gap remote from the inlet for discharging liquid fuel passing through said gap to the intake side of a fuel pump, a bellows at the opposite end of said piston from said gap and having a bellows plate attached to the said opposite end of said piston, and means connected to said bellows for communicating the interior of the bellows with the static pressure of a Venturi in the air intake of the fuel supply apparatus; and an acceleration mechanism connected to said bellows for supplying air under pressure to the outside of said bellows.

4. A fuel supply apparatus for supplying fuel to a spark ignition type internal combustion engine, said apparatus comprising: a fuel and air mixing chamber; an air intake conduit having a Venturi throat opening into said mixing chamber; an air flow measuring means for detecting a negative pressure in said Venturi throat of said air intake conduit as an indication of volume of air flow therethrough; a volume type liquid fuel pump; a fuel jet nozzle connected to the discharge side of said fuel pump and directed into said mixing chamber; a bypass connected between the discharge side and the intake side of said fuel pump; a variable throttle in said bypass; pressure adjusting means, connected to said variable throttle and responsive to atmospheric pressure, to the negative pressure at the air flow measuring means and to the pressure on the discharge side of said fuel pump, for regulating said variable throttle such that the ratio of the differential pressure between said negative pressure and atmospheric pressure and the pump discharge pressure is equal to n, the value of n being sufficient for causing the fuel flow in the jet nozzle to be turbulent; a volume control mechanism connected to the mixing chamber for controlling the outflow of the mixture of air and fuel to the engine intake manifold, said mixing chamber including an upper wall and an annular outer wall and a lower wall defining said mixing chamber, said jet nozzle being in said upper wall on the central axis of said annular wall, said lower wall having an outlet port to said volume control mechanism, and said annular wall having air inlet ports around the upper and lower edges thereof.

5. A fuel supply apparatus as claimed in claim 1, wherein said jet nozzle is a swirl type nozzle.

6. A fuel supply apparatus as claimed in claim 1, wherein said variable throttle comprises a cylinder and a piston slidable in said cylinder, said piston and cylinder having an annular gap therebetween forming the variable opening of said throttle and the length of said gap being controlled by the movement of said piston in said cylinder.

7. A fuel supply apparatus as claimed in claim 1, wherein said air flow measuring means comprises a Venturi in the air intake conduit.

8. A fuel supply apparatus as claimed in claim 1 wherein said mixing chamber further has an annular air filter around said annular wall.

9. A fuel supply apparatus as claimed in claim 1, wherein said mixing chamber has a flexible tube connected thereto as an outlet conduit for the mixture of fuel and air, and said volume control mechanism comprises a radially movable throttle valve means around said tube for radially collapsing said flexible tube and having a length in the direction of the length of the tube greater than the diameter of the tube.

10. A fuel supply apparatus as claimed in claim 1, wherein said air intake conduit has a Venturi therein, and said apparatus further comprises a bypass connected around said Venturi and an air/fuel ratio adjusting device having a throttle valve therein in said bypass.

11. A fuel supply apparatus as claimed in claim 1, further comprising a further volume type liquid pump, a further jet nozzle in said mixing chamber, a further bypass connected between the discharge and intake sides of said further pump, a further variable throttle in said further bypass, and a further pressure adjusting device connected to said further variable throttle, said further pump, jet nozzle, bypass, variable throttle and pressure adjusting device being connected in parallel to said first mentioned pump, jet nozzle, bypass, variable throttle and pressure adjusting device for supplying water to said mixing chamber.

12. A fuel supply apparatus as claimed in claim 1, further comprising an engine acceleration control means having means for supplying fuel directly to the mixing chamber for accelerating the engine.

* * * * *